US007427161B2

(12) United States Patent
Sill et al.

(10) Patent No.: US 7,427,161 B2
(45) Date of Patent: Sep. 23, 2008

(54) PLASTIC BAG WITH UNITARY HANDLE AND CLOSURE MEMBER

(75) Inventors: Jonathan D. Sill, Caledonia, OH (US); Todd Sill, Lewis Center, OH (US)

(73) Assignee: Inno-Pak, Delaware, OH (US)

( * ) Notice: Subject to any disclaimer, the term of this patent is extended or adjusted under 35 U.S.C. 154(b) by 608 days.

(21) Appl. No.: 10/928,060

(22) Filed: Aug. 27, 2004

(65) Prior Publication Data

US 2006/0045390 A1 Mar. 2, 2006

(51) Int. Cl.
*B65D 33/06* (2006.01)

(52) U.S. Cl. ..... 383/25; 383/6; 383/29; 383/78; 383/127

(58) Field of Classification Search ..... 383/6, 383/29, 120, 78, 102, 127, 81, 25
See application file for complete search history.

(56) References Cited

U.S. PATENT DOCUMENTS

| | | | | | |
|---|---|---|---|---|---|
| 1,792,885 | A * | 2/1931 | Andrews | 383/25 |
| 2,050,967 | A * | 8/1936 | Farmer | 383/6 |
| 2,149,030 | A * | 2/1939 | Moore | 229/76 |
| 2,693,836 | A * | 11/1954 | Hayes | 383/29 |
| 2,846,134 | A * | 8/1958 | Moubayed | 229/117.26 |
| 3,203,621 | A * | 8/1965 | Wright | 383/81 |
| 4,243,171 | A * | 1/1981 | Prin | 229/117.16 |
| 5,035,515 | A * | 7/1991 | Crossman et al. | 383/38 |
| 5,824,380 | A * | 10/1998 | Hagen | 428/41.9 |
| 6,286,681 | B1 * | 9/2001 | Wilfong et al. | 206/554 |
| 6,361,209 | B1 * | 3/2002 | LaRue et al. | 383/10 |
| 7,004,632 | B2 * | 2/2006 | Hamilton et al. | 383/103 |
| 2005/0041894 | A1 * | 2/2005 | Hanson | 383/120 |
| 2005/0047686 | A1 * | 3/2005 | Elsaesser | 383/78 |

FOREIGN PATENT DOCUMENTS

| | | | |
|---|---|---|---|
| DE | 2733041 | A * | 2/1978 |
| DE | 19831584 | A1 * | 1/2000 |
| WO | WO 2004071890 | A1 * | 8/2004 |

* cited by examiner

*Primary Examiner*—Nathan J Newhouse
*Assistant Examiner*—Jack H Morgan, Jr.
(74) *Attorney, Agent, or Firm*—Porter, Wright, Morris & Arthur, LLP

(57) ABSTRACT

A plastic bag includes a body portion, a handle portion forming an opening adapted to be grasped to carry the body portion, and a closure portion. The body portion has a bottom, opposed front and back panels extending from the bottom, and opposed first and second side panels extending from the bottom and connecting the front and back panels. The bottom, the front and back panels, and the first and second side panels form a receptacle space having a mouth located opposite the bottom. Preferably, the bottom is flat and the first and second side portions form gussets. The handle portion and the closure portion are preferably formed by adjacent layers of a folded plastic sheet secured to the back panel. The closure portion preferably includes a layer of pressure sensitive adhesive to be secured to the front panel to close the mouth.

17 Claims, 6 Drawing Sheets

PLASTIC BAG WITH UNITARY HANDLE AND CLOSURE MEMBER

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to plastic bags and, more particularly, to plastic bags having a closure and a handle.

BACKGROUND OF THE INVENTION

Plastic bags are often used for holding and transporting food products which are purchased at grocery stores, restaurants and other food retailers. For example, plastic bags can be used to hold and transport rotisserie chickens which are "ready to serve". It is desirable for these plastic bags to have a closure and a handle because the rotisserie chickens are often warm or hot when placed into the plastic bags.

Plastic bags having flat bottoms and gusseted sides provide a desirable combination of relatively large volume for holding food during use and relatively small size for shipping and storage prior to use. However, it is difficult to cost effectively provide plastic bags having flat bottoms and gusseted sides with handles and closures. Accordingly, there is a need in the art for an improved plastic bag having a handle and a closure, that is relatively inexpensive to produce, and/or that is relatively easy to fill and close.

SUMMARY OF THE INVENTION

The present invention provides a plastic bag which overcomes at least some of the above-noted problems. In accordance with one aspect of the present invention, a plastic bag comprises, in combination, a body portion and a unitary handle and closure member secured to the body portion. The body portion includes a bottom, opposed front and back panels extending from the bottom, and opposed first and second side panels extending from the bottom and connecting the front and back panels. The bottom, the front and back panels, and the first and second side panels form a receptacle space having a mouth located opposite the bottom. The handle and closure member has a handle portion forming an opening adapted to be grasped to carry the body portion and a closure portion adapted to close the mouth.

According to another aspect of the present invention, a plastic bag comprises, in combination, a body portion having a bottom, opposed front and back panels extending from the bottom, and opposed first and second side panels extending from the bottom. The bottom, the front and back panels, and the first and second side panels form a receptacle space having a mouth located opposite the bottom. The bottom is flat and the first and second side portions form gussets. A handle portion forms an opening adapted to be grasped to carry the body portion. A closure portion adapted to close the mouth. The handle portion and the closure portion are formed by adjacent first and second layers of a folded plastic sheet secured to the body portion.

According to another aspect of the present invention, a plastic bag comprises, in combination, a body portion having a bottom, opposed front and back panels extending from the bottom, and opposed first and second side panels extending from the bottom. The bottom, the front and back panels, and the first and second side panels form a receptacle space having a mouth located opposite the bottom. The bottom is flat and the first and second side portions form gussets. A handle portion forms an opening adapted to be grasped to carry the body portion. A closure portion is adapted to close the mouth. The handle portion is formed by adjacent first and second layers of a folded plastic sheet secured to the body portion and the closure portion is formed by a third layer of the plastic sheet adjacent to the first and second layers.

From the foregoing disclosure and the following more detailed description of various preferred embodiments it will be apparent to those skilled in the art that the present invention provides a significant advance in the technology and art of plastic bags. Particularly significant in this regard is the potential the invention affords for providing a high quality, reliable, low cost plastic bag assembly which includes a handle and a closure. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 7:
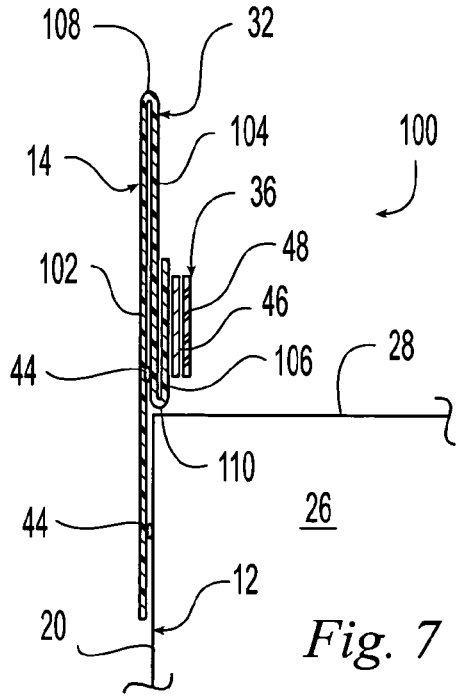
FIG. 7 is a fragmented cross-sectional view showing the unitary handle and closure member of the plastic bag of FIG. 6.
Figure 8:
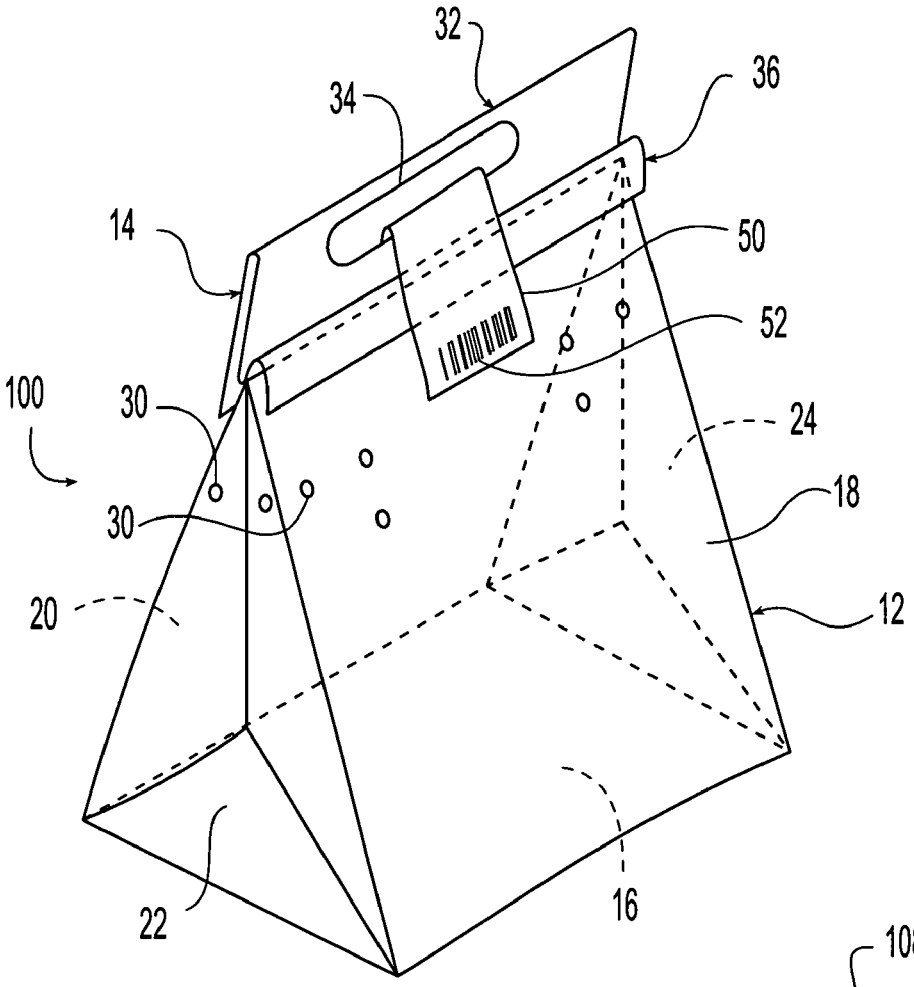
FIG. 8 is a perspective view of the plastic bag of FIGS. 6 and 7, wherein the bag is closed.
Figure 9:
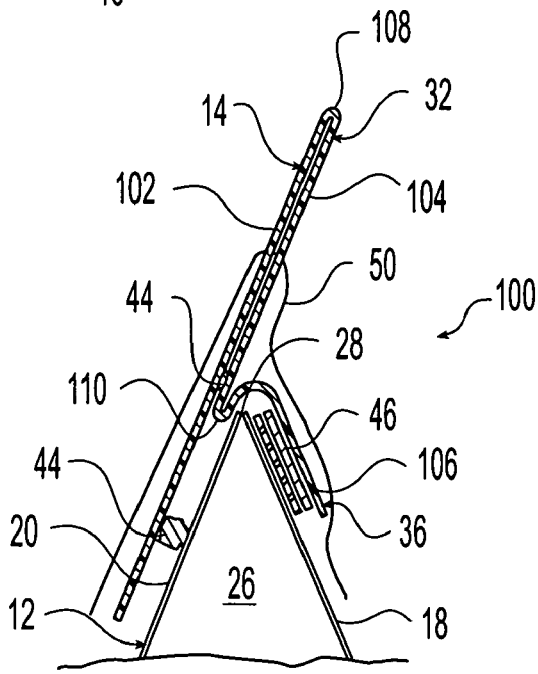
FIG. 9 is a fragmented cross-sectional view showing the unitary handle and closure member of FIGS. 6 to 8 with the plastic bag closed.

It should be understood that the appended drawings are not necessarily to scale, presenting a somewhat simplified representation of various preferred features illustrative of the basic principles of the invention. The specific design features of a plastic bag as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the plastic illustrated in the drawings. In general, up or upward refers to a direction toward the open ends of the plastic bags shown in the figures, that is, an upward direction within the plane of the paper in FIGS. 2 and 7 and down or downward refers to a direction toward the closed end of the plastic bags shown in the figures, that is, a downward direction within the plane of the paper in FIGS. 2 and 7.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved plastic bag disclosed herein. The following detailed discussion of various alternative and preferred embodiments will illustrate the general principles of the invention with reference to a plastic bag suitable for use in holding and transporting food products such as rotisserie chickens. Other embodiments suitable for other applications will be apparent to those skilled in the art given the benefit of this disclosure.

Figure 1:
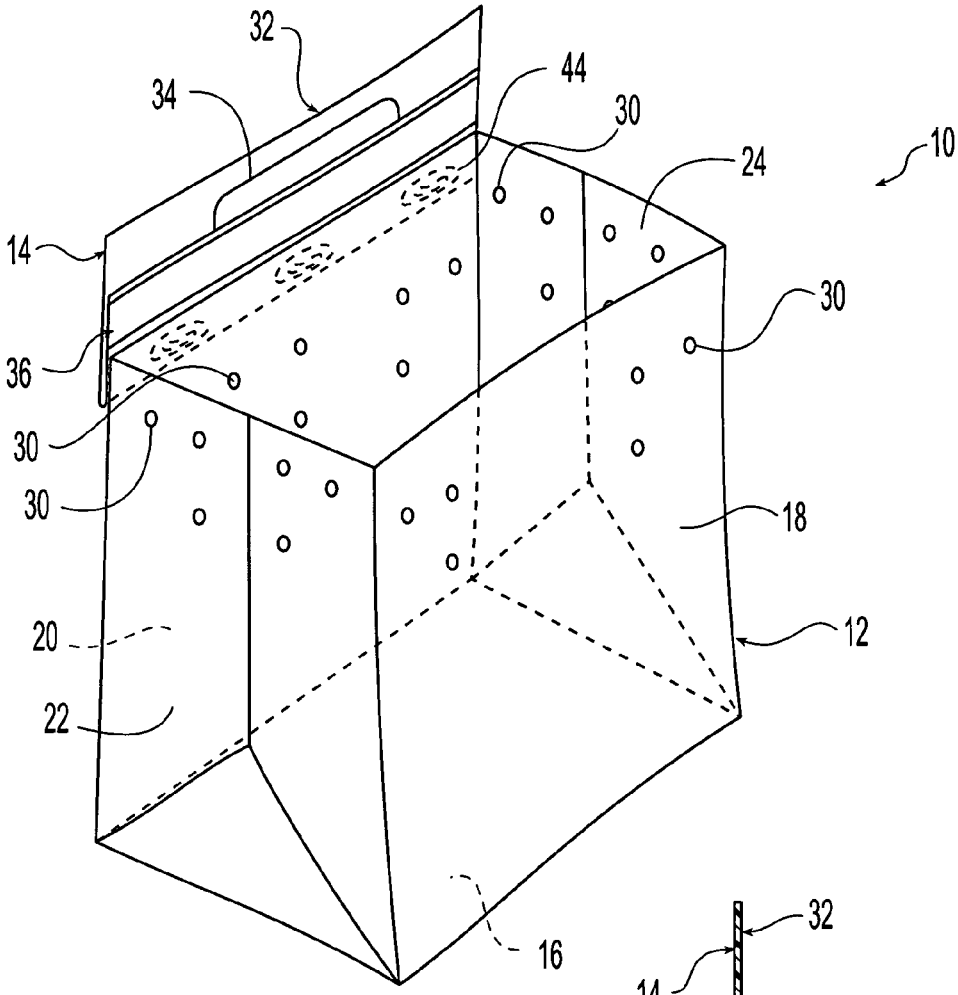
FIG. 1 is a perspective view of a plastic bag according to a first embodiment of the present invention, wherein the plastic bag is open.
Figure 2:
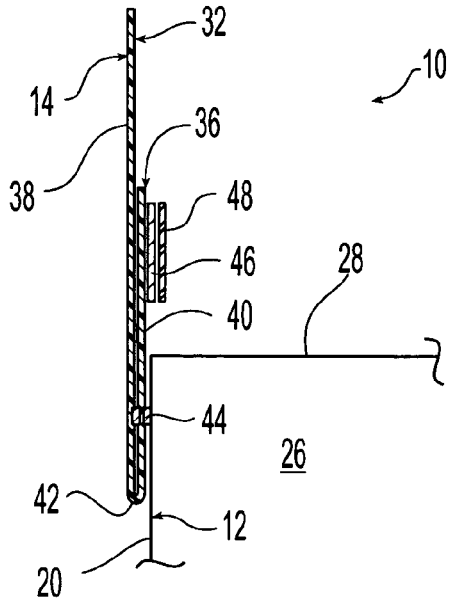
FIG. 2 is a fragmented cross-sectional view showing a unitary handle and closure member of the plastic bag of FIG. 1.

Referring now to the drawings, FIGS. 1 and 2 illustrate a plastic bag 10 according to a first preferred embodiment the present invention. The illustrated plastic bag 10 includes a body portion 12 and a unitary handle and closure member 14 secured to the body portion 12.

The body portion 12 includes a bottom panel or wall 16, opposed front and back panels or walls 18, 20 upwardly extending from front and back edges of the bottom panel 16, and opposed first and second side panels or walls 22, 24 upwardly extending from left and right edges of the bottom panel 16. The first and second side panels 22, 24 connect side edges of the front and back panels 18, 20. The panels 16 to 24 are sized and shaped to form a generally rectangular shaped receptacle space or cavity 26 having a mouth or opening 28 at the top of the body portion 12, that is, opposite the bottom panel 16. The body portion 12 is preferably formed by folding and heat welding a length of flexible plastic tube. The body portion 12 is preferably adapted so that the body portion 12 is easily converted between an expanded use configuration (shown in FIG. 1) and a collapsed shipping/storage configuration (not specifically shown). The illustrated body portion 12 is provided with a substantially flat bottom panel 18, folded gussets formed in the first and second side panels 22, 24, and a horizontal fold in the front panel 18 so that the body portion 12 can be easily folded and unfolded between the use and shipping/storage configurations.

The body portion 12 is formed of any suitable flexible plastic material such as, for example, high density polyethylene (HDPE), low density polyethylene (LDPE), or linear low density polyethylene (LLDPE). The body portion 12 is preferably formed of material suitable for use in a microwave oven so that the rotisserie chicken or other food product can be warmed in the plastic bag 10 prior to its removal from the plastic bag 10 if desired. The illustrated plastic bag 10 is provided with a plurality of vent openings 30 on each of the front and back panels 18, 20 and the first and second side panels 22, 24 for the release of hot air and steam, which is particularly advantageous if the rotisserie chicken or other food product is to be micro waved while in the plastic bag 10.

The illustrated handle and closure member 14 includes a handle portion 32 forming an opening 34 sized and shaped to be grasped by the hand of a user to carry the body portion 12 and a closure portion 36 adapted to generally close the mouth 28 of the receptacle space 26 once the food product is placed within the receptacle cavity 26. The illustrated handle and closure member 14 is unitary, that is, is formed of a single piece or sheet of material. The illustrated handle and closure member 14 is formed of a single sheet of plastic with the handle portion 32 and the closure portion 36 formed by adjacent first and second layers 38, 40 of the folded plastic sheet. The first layer 38 forms the handle portion 32 and is located rearward of the second layer 40 which is adjacent the back panel 20 of the body portion 12 such that the second layer 40 is located between the first layer 38 and the back pane 201. The illustrated first and second layers 38, 40 are connected at a fold 42 located at their lower ends. It is noted, however, that alternatively, the fold 42 can be located at their upper ends, or can be eliminated. The illustrated first layer 38 has a greater height such that it extends upwardly beyond the top of the second layer 40. It is noted, however, that the first layer 38 can alternatively have a lesser or equal height to that of the second layer 40.

The handle and closure member 14 can be formed from the same material as the body portion 12. The illustrated handle and closure member 14 is secured to the body portion 12 at the top of the back panel 20 near the mouth 28 such that the lower ends of the first and second layers 38, 40 overlap the upper end of the back panel 20 of the body portion 12. It is noted, however, that other suitable locations can alternatively be utilized depending on the use application of the plastic bag 10. The illustrated handle portion 32 is secured to the body portion 12 by welds 44 such as heat welds located along the upper end of the back panel 20 to secure the first and second layers 38, 40 and the back panel 20 together. It is noted, however, that the handle and closure member 14 can alternatively be secured to the body portion 12 in any other suitable manner such as, for example, adhesives, fasteners, or formed unitary with any part of the body portion.

The illustrated closure portion 36 is sized and shaped to be folded over the mouth 28 such that the second layer 40 overlaps the upper end of the front panel 18 and is secured thereto to close or seal the mouth 28 of the body portion 12. The illustrated first layer 38 is provided with a layer of pressure sensitive adhesive 46 to selectively secure the first layer 38 to the front panel 18. The illustrated adhesive layer 46 is located at an upper end of the second layer 40 on its forward side (as viewed in FIGS. 1 and 2) opposite the first layer 38. The illustrated adhesive layer 46 is provided with a release paper or sheet 48 to protect the adhesive layer 46 prior to use.

Figure 3:
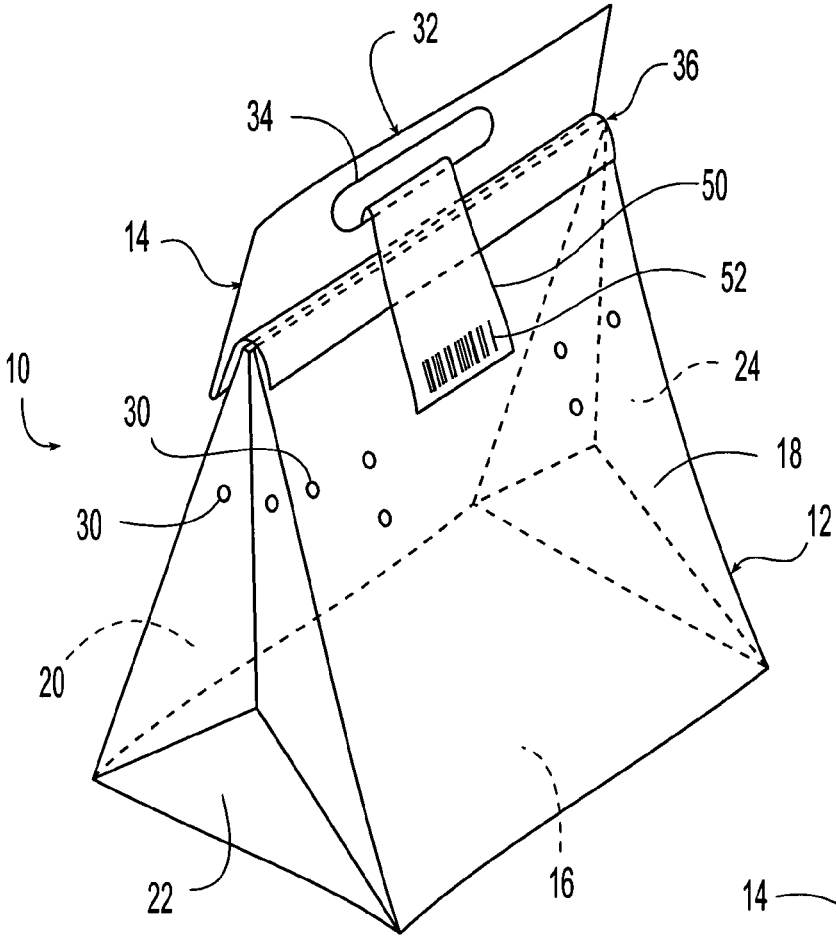
FIG. 3 is a perspective view of the plastic bag of FIGS. 1 and 2, wherein the bag is closed.
Figure 4:
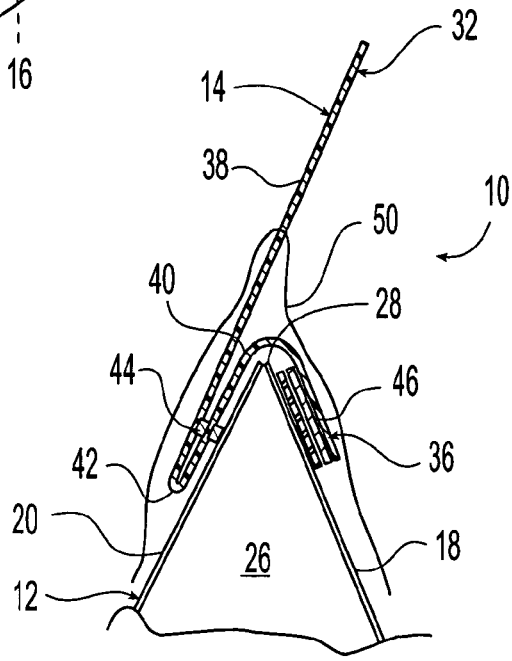
FIG. 4 is a fragmented cross-sectional view showing the unitary handle and closure member of FIGS. 1 to 3 with the plastic bag closed.

The plastic bag 10 is preferably shipped and stored in its folded or collapsed configuration and unfolded to its use configuration (shown in FIG. 1) when it is ready to be used. The rotisserie chicken or other food product is placed into the receptacle space 26 within the body portion 12. The store clerk or other user then removes the release paper 48 from the adhesive layer 46 on the closure portion 36 and brings the upper ends of the front and back panels 18, 20 together. With the upper ends of the front and panels 18, 20 together or nearly so, the store clerk folds the handle portion 32 over the mouth 28 until the adhesive layer 46 of the closure portion 36 engages the front panel 18 and applies pressure to secure the closure portion 36 to the front panel 18 to close or seal the plastic bag 10. When the handle portion 32 is released, it resiliently springs back upward for use as a handle while the closure portion 36 remains secured to the front panel 18. As best shown in FIGS. 3 and 4, a label 50 is preferably affixed to the plastic bag 10 which extends from the front panel 18 to the back panel 20 through the opening 34 in the handle portion 32. The label 50 is preferably secured using adhesive. The label 50 preferably includes a UPC bar code 52 and can include any other desirable information such as weight, cost etc. The consumer can open the plastic bag 10 by removing the closure portion 36 from the front panel 18 and tearing the label 50.

Figure 5:
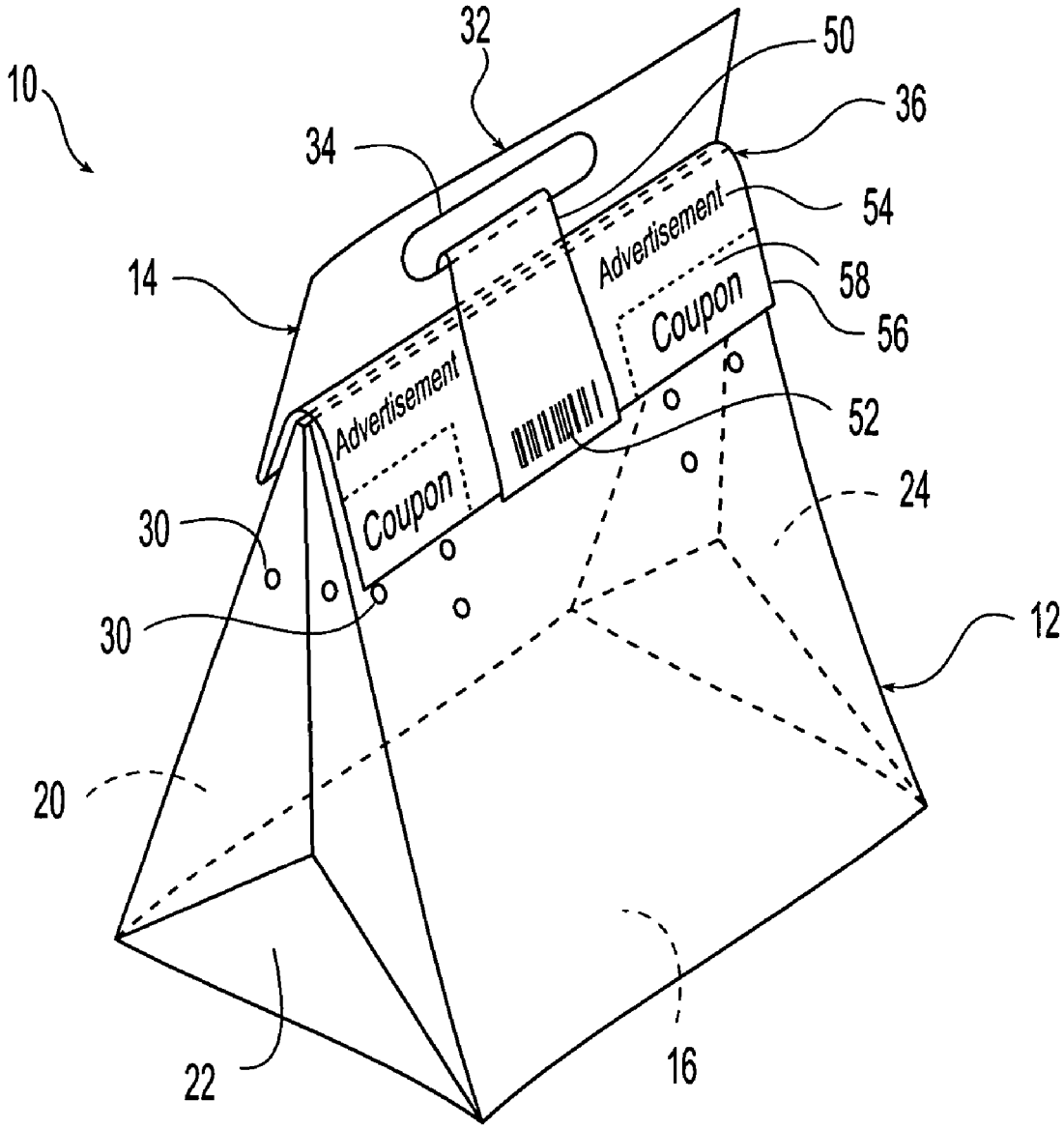
FIG. 5 is a perspective view of a variation of the plastic bag of FIGS. 1 to 4, wherein the unitary handle and closure member includes coupons.
Figure 6:
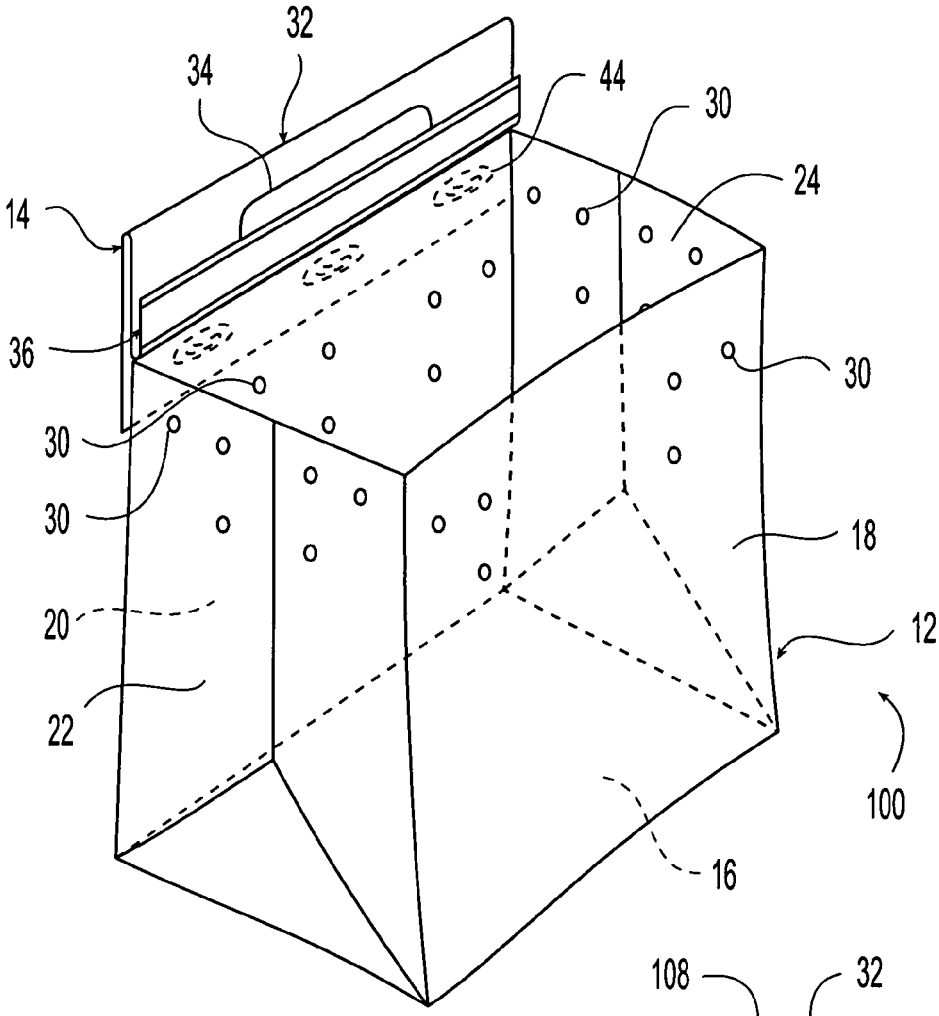
FIG. 6 is a perspective view of a plastic bag according to a second embodiment of the present invention, wherein the plastic bag is open.

FIG. 5 illustrates a variation of the handle and closure member 14 described hereinabove wherein the handle and closure member 14 is provided with promotional or advertising messages or advertisements 54 and a redeemable coupon or premium 56. The advertising messages 54 and the coupon 56 can be marked or printed directly onto the surface of the handle and closure member 14 using any suitable printing method or can alternatively be provided by labels adhered to the surface of the handle and closure member 14. The advertising or promotional messages 54 can be used to promote the store or sold to others to at least partially offset the cost of the plastic bags 10. The coupon 56 can be a store redeemable coupon for either items purchased in the plastic bag 10 items relating to the items purchased in the plastic bag 10, or any other item. The illustrated coupon 56 is provided with scored or perforation lines 58 so that the coupon 56 can be easily separated from the remainder of the handle and closure member 14 by the purchaser. It is noted that the handle and closure member 14 can have solely advertising messages 54 of any quantity, solely coupons 56 of any quantity, or any combination and quantities of both advertising messages 54 and coupons 56. The illustrated coupons 56 are located at the free edge of the second layer 40 of the handle and closure member 14 but it is noted that the coupons 56 can alternatively be located at any other location on the handle and closure member 14.

FIGS. 6 to 9 illustrate a plastic bag 100 according to a second preferred embodiment the present invention. The plastic bag 100 according to the second preferred embodiment is substantially the same as the plastic bag 10 according to the first preferred embodiment except for the configuration of the handle and closure member 14. Like reference numbers are utilized throughout the figures to indicate like structure. The second embodiment illustrates that the handle and closure member 14 can take other forms and, more particularly, that the handle and closure member 14 can have other quantities of plastic layers.

The illustrated handle and closure member 14 is formed of a single sheet of plastic with the handle portion 32 and the closure portion 36 formed by adjacent first, second and third layers 102, 104, 106 of the folded plastic sheet. The first and second layers 102, 104 form the handle portion 32 and together form the opening 34. First layer 102 is located rearward of the second layer 104 and has a lower end adjacent the back panel 20 of the body portion 12 and is secured to the back panel 20 such as by the illustrated welds 44. The second layer 104 is located forward of the first layer 102 and extends from the top of the first layer 102 to near the mouth 28 of the body portion 12. The illustrated first and second layers 102, 104 are connected by a first fold 108 located at their upper ends. It is noted, however, that alternatively, the fold 108 can be can be eliminated if the layers 102, 104 are otherwise suitably connected. The third layer 106 forms the closure portion 36 and is located forward of the second layer 104 and extends upwardly from the bottom of the second layer 104. The third layer 106 is sized and shaped to fold over and close the mouth 28 of the body portion 12 as describe hereinabove. The illustrated second and third layers 104, 106 are connected by a second fold 110 located at their lower ends. It is noted, however, that alternatively, the fold 110 can be can be eliminated if the layers 104, 106 are otherwise suitably connected.

Figure 10:
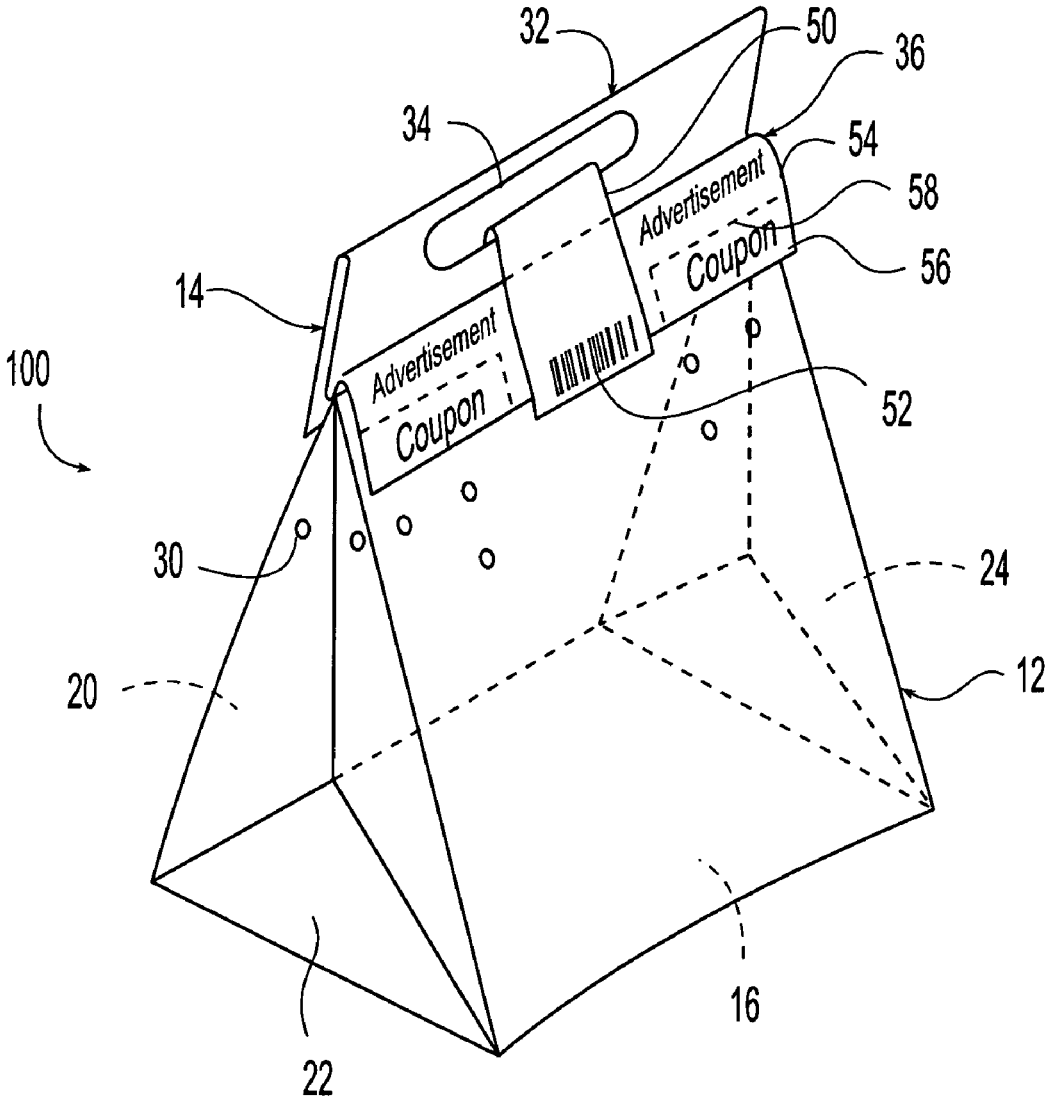
FIG. 10 is a perspective view of a variation of the plastic bag of FIGS. 6 to 9, wherein the unitary handle and closure member includes coupons.

FIG. 10 illustrates a variation of the handle and closure member 14 of the plastic bag 100 of second embodiment described hereinabove. This variation illustrates that the handle and closure member 14 can be provided with promotional or advertising messages 54 or advertisements 54 and a redeemable coupon or premium 56 as described in detail hereinabove with regard to the plastic bag 10 of the first embodiment.

From the foregoing disclosure and detailed description of certain preferred embodiments, it should be appreciated that the present invention provides a improved plastic bag 10, 1000 having a handle portion 32 and a closure portion 36, that is relatively inexpensive to produce, and/or that is relatively easy to fill and close.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A plastic bag comprising, in combination:

a body portion having a bottom, opposed front and back panels extending from the bottom, and opposed first and second side panels extending from the bottom and connecting the front and back panels;

wherein the bottom, the front and back panels, and the first and second side panels form a receptacle space having a mouth located opposite the bottom;

a unitary handle and closure member secured to the body portion;

wherein the handle and closure member has a handle portion forming an opening adapted to be grasped to carry the body portion and a closure portion adapted to close the mouth;

wherein the handle portion is secured to the back panel of the body portion and includes a first layer of a folded plastic sheet and the closure portion includes a second layer of the plastic sheet;

wherein lower ends of the first layer and the second layer are connected by a fold with the second layer located adjacent the first layer at a forward side of the first layer and a free upper end of the second layer opposite the lower end of the second layer is foldable over the mouth and connectable to the front panel to close the mouth; and wherein the fold connecting the lower ends of the first and second layers is located adjacent the back panel between the mouth and the bottom.

2. The plastic bag according to claim 1, wherein the bottom is flat and the first and second side portions form gussets.

3. The plastic bag according to claim 1, wherein the handle and closure member is formed of a single sheet of plastic.

4. The plastic bag according to claim 1, wherein the closure portion includes a layer of pressure sensitive adhesive located at a forward side of the free upper end of the second layer and connectable to the front panel to close the mouth when the second layer is folded around the mouth.

5. The plastic bag according to claim 1, wherein the second layer is located between the first layer and the back panel and the first and second layers are each secured to the back panel.

6. The plastic bag according to claim 5, wherein the first and second layers are each heat welded to the back panel of the body portion.

7. The plastic bag according to claim 1, wherein the handle and closure member includes at least one coupon.

8. The plastic bag according to claim 7, wherein the handle and closure member includes at least one perforation line such that the coupon can be removed from the remainder of the handle and closure member.

9. A plastic bag comprising, in combination:

a body portion having a bottom, opposed front and back panels extending from the bottom, and opposed first and second side panels extending from the bottom and connecting the front and back panels;

wherein the bottom, the front and back panels, and the first and second side panels form a receptacle space having a mouth located opposite the bottom;

wherein the bottom is flat and the first and second side portions form gussets;

a handle portion forming an opening adapted to be grasped to carry the body portion;

a closure portion adapted to close the mouth;

wherein the handle portion includes a first layer of a folded plastic sheet and the closure portion includes a second layer of the folded plastic sheet;

wherein lower ends of the first layer and the second layer are connected by a fold with the second layer located adjacent the first layer at a forward side of the first layer and between the first layer and the back wall;

wherein each of the first layer and the second layer are secured to the back panel; and wherein a free upper end of the second layer is foldable over the mouth and connectable to the front panel to close the mouth; and wherein each of the first layer and the second layer of the folded plastic sheet is heat welded to the back panel of the body portion.

10. The plastic bag according to claim 9, wherein the closure portion includes a layer of pressure sensitive adhesive located at a forward side of the free upper end of the second layer and connectable to the front panel to close the mouth when the second layer is folded around the mouth.

11. The plastic bag according to claim 9, wherein the folded plastic sheet includes at least one coupon.

12. The plastic bag according to claim 11, wherein the folded plastic sheet includes at least one perforation line such that the coupon can be removed from the remainder of the handle and closure member.

13. A plastic bag comprising, in combination:

a body portion having a bottom, opposed front and back panels extending from the bottom, and opposed first and second side panels extending from the bottom and connecting the front and back panels;

wherein the bottom, the front and back panels, and the first and second side panels form a receptacle space having a mouth located opposite the bottom;

wherein the bottom is flat and the first and second side portions form gussets;

a handle portion forming an opening adapted to be grasped to carry the body portion;

a closure portion adapted to close the mouth;

wherein the handle portion includes a first layer of a folded plastic sheet and a second layer of the folded plastic sheet and upper ends of the first layer and the second layer are connected by a first fold with the second layer located adjacent the first layer at a forward side of the first layer;

wherein the first layer is secured to the back panel of the body portion and a lower end of the second layer is secured to the first layer;

wherein the closure portion includes a third layer of the folded plastic sheet;

wherein lower ends of the second layer and the third layer are connected by a second fold with the third layer located adjacent the second layer at a forward side of the second layer and a free upper end of the third layer is foldable over the mouth and connectable to the front panel to close the mouth; and wherein the second layer is located between the first layer and the third layer.

14. The plastic bag according to claim 13, wherein the closure portion includes a layer of pressure sensitive adhesive located at a forward side of the free upper end of the third layer and connectable to the front panel to close the mouth when the third layer is folded around the mouth.

15. The plastic bag according to claim 13, wherein the first layer of the folded plastic sheet is heat welded to the back panel of the body portion.

16. The plastic bag according to claim 13, wherein the folded plastic sheet includes at least one coupon.

17. The plastic bag according to claim 16, wherein the folded plastic sheet includes at least one perforation line such that the coupon can be removed from the remainder of the handle and closure member.

* * * * *